US005338017A

United States Patent [19]

Stemmle

[11] Patent Number: 5,338,017

[45] Date of Patent: Aug. 16, 1994

[54] SORTING AND FINISHING APPARATUS

[75] Inventor: Denis J. Stemmle, Webster, N.Y.

[73] Assignee: Xerox Corporation, Stamford, Conn.

[21] Appl. No.: 996,424

[22] Filed: Dec. 23, 1992

[51] Int. Cl.[5] ..... B42B 2/00

[52] U.S. Cl. ..... 270/53; 270/58; 271/220; 271/292

[58] Field of Search ..... 270/53, 58; 355/324; 271/184, 220, 225, 248, 292, 294

[56] References Cited

U.S. PATENT DOCUMENTS

| | | | |
|---|---|---|---|
| 4,274,624 | 6/1981 | Sato et al. | 271/294 X |
| 4,376,529 | 3/1983 | George et al. | 270/53 |
| 4,497,478 | 2/1985 | Reschenhofer et al. | 270/53 |
| 4,558,860 | 12/1985 | Stemmle | 271/293 |
| 4,605,211 | 8/1986 | Sonobe | 270/53 |
| 4,687,191 | 8/1987 | Stemmle | 270/53 |
| 4,925,171 | 5/1990 | Kramer et al. | 270/53 |
| 5,169,134 | 12/1992 | Ishiguro et al. | 270/53 |
| 5,203,550 | 4/1993 | Kawano et al. | 270/53 |
| 5,251,892 | 10/1993 | No et al. | 271/184 |

FOREIGN PATENT DOCUMENTS 2173483 10/1986 United Kingdom .

*Primary Examiner*—Edward K. Look
*Assistant Examiner*—John Ryznic
*Attorney, Agent, or Firm*—Kevin R. Kepner

[57] ABSTRACT

A sorter apparatus for receiving and attaching sets of sheet material in succession at a sheet input station. A plurality of bins are provided for receiving the sheet material in a first position within each bin. The bin has a slidable tray mounted thereon. The slideable tray is movable in a direction, transverse to the sheet input direction, to displace the sheet material, received within each bin, to a second position where the sheet set is attached. The slideable tray is then returned to the first position and another bin is positioned at the sheet attaching position where the process is repeated.

16 Claims, 8 Drawing Sheets

SORTING AND FINISHING APPARATUS

This invention relates to an automatic sheet sorting and finishing apparatus adapted to be mounted to a sheet outputting machine. More specifically, the present invention is directed to an improved sorting and finishing apparatus of an image reproducing apparatus, such as an electrophotographic printing machine, comprising a generally vertical array of horizontally extending bins, with each bin having a slidable tray mounted thereto for horizontally displacing a set of sheet material, positioned within the bin, into a binding apparatus, such as a stapler.

Automated reproducing apparatuses, and in particular automated office copiers, have the capability of producing a plurality of copies of an original document or other information. In many applications for such office copiers, it is desirable to produce collated sets of copies of the original multi-page document. The collation of the individual copies made by such office copiers into sets is achieved with the utilization of a sorter which generally comprises a plurality of bins wherein each bin is designed to collect a single set of copies of the original document.

A variety of sorters are well known in the art. Recently, sorters have been developed which provide in bin stapling. The problem with such sorters is the accessibility of the stapler. The staplers are often not easily removable for reloading staples, restapling documents after completing a copy job, clearing staple jams, and customer replacement of failed staplers. There exists a need for a sorting and finishing apparatus with an easily accessible stapler.

The following disclosures may be relevant to various aspects of the present invention:

U.S. Pat. No. 4,376,529
Patentee: George et al.
Issued: Mar. 15, 1983
U.S. Pat. No. 4,558,860
Patentee: Stemmle
Issued: Dec. 17, 1985
U.S. Pat. No. 4,687,191
Patentee: Dennis J. Stemmle
Issued: Aug. 18, 1987
U.S. Pat. No. 4,925,171
Patentee: Kramer et al.
Issued: May 15, 1990
GB-2,173,483A
Inventor: Stemmle
Published: Oct. 15, 1986

The relevant portions of the foregoing disclosures may be briefly summarized as follows:

U.S. Pat. No. 4,376,529 discloses a finishing station for a reproducing machine including a generally vertical array of bins. Each of the bins is pivotally mounted on an elevator screw to provide bidirectional sorting of the copy sheets fed into the bins. A bin pivot motor drives a cam to a cam follower to pivot a bin through an arc to a stapling station. In the finishing operation, each of the bins is sequentially pivoted to the stapler station. A gripper mechanism is utilized to unload the stapled set into collecting bins.

U.S. Pat. No. 4,558,860 discloses a sorting apparatus which has a nest of a plurality of sheet receiving bins supported on a sorting support frame. Each bin has a sheet output end and a sheet input end. The plurality of bins are pivotally mounted at their output end about the same pivot point on the support frame such that the output end of each bin is at a level higher than its input end. A rotary shifting member sequentially pivots the bins about their pivoting mount to index the bins past the fixed feed throat for sheet insertion. As the bins are indexed past the fixed feed throat the rotary shifting member widely spaces adjacent bins to provide sheet entry for successive bins.

U.S. Pat. No. 4,687,191 discloses a sheet sorter of the nesting bin type. Translatable bins are driven so that there is an additional space between the bin immediately on top of a sheet entry location in any superposed bin, thereby providing access to a corner of a set of sheets registered in that bin. A stapler is reciprocal between a remote position permitting free indexing of the bins and an inner position in which it can be operated to staple the respective set of sheets together.

U.S. Pat. No. 4,925,171 discloses a sorter for sorting sheets fed from a sequential source of sheets. The sorter comprises a closely vertical spaced array of sorted bins. Also disclosed is an apparatus to vertically move the array of sorter bins relative to the source of sheets for sequentially loading individual sheets into the individual sorter bins. The system partially horizontally displaces the sorter bins to move one displaced bin at a time into the stapler for stapling the sheets sorted in that bin without removal therefrom. The partially horizontal displacement of the sorter bins is achieved by utilizing individual pins connected with respective individual sorter bins in a substantially vertically aligned array and an open jaw actuating system through which the array of pins is movable. The open jaw is adapted to engage and horizontally move a selected pin therein. An alternative cam track system with horizontal displacement transition therein is also disclosed for this function.

GB-2,173,483A discloses a sorter/stapler utilizing a tamper having a clamping mechanism for moving a set of sheets to a stapler and returning the stapled set to the bin.

In accordance with one aspect of the present invention, there is provided an apparatus for sorting sheets. The apparatus comprises a plurality of movable bins shiftable relative to one another with each of the plurality of bins including means for movably supporting the sheets in the bin, the supporting means aligning the sheets in the bin in a sheet aligning position. Means for attaching the sheets of one of the plurality of bins to one another at a sheet attaching position, the supporting means moving the sheets of the one of the plurality of bins from the sheet aligning position to the sheet attaching position enabling the attaching means to attach the sheets to one another is also provided.

Pursuant to another aspect of the present invention, there is provided a printing system, comprising means for printing information in sheets. Means, positioned to receive the sheets from the printing means at a sheet inlet region for sorting the sheets, the sorting means comprising a plurality of movable bins shiftable relative to one another with each of the plurality of bins including means for movably supporting the sheets in the bin, the supporting means aligning the sheets in the bin in a sheet aligning position and means for attaching the sheets of one of the plurality of bins to one another at a sheet attaching position, the supporting means moving the sheets of the one of the plurality of bins from the sheet aligning position to the sheet attaching position enabling the attaching means to attach the sheets to one another are also provided.

Other features of the present invention will become apparent as the description thereof proceeds and upon reference to the drawings in which.

Figure 1:
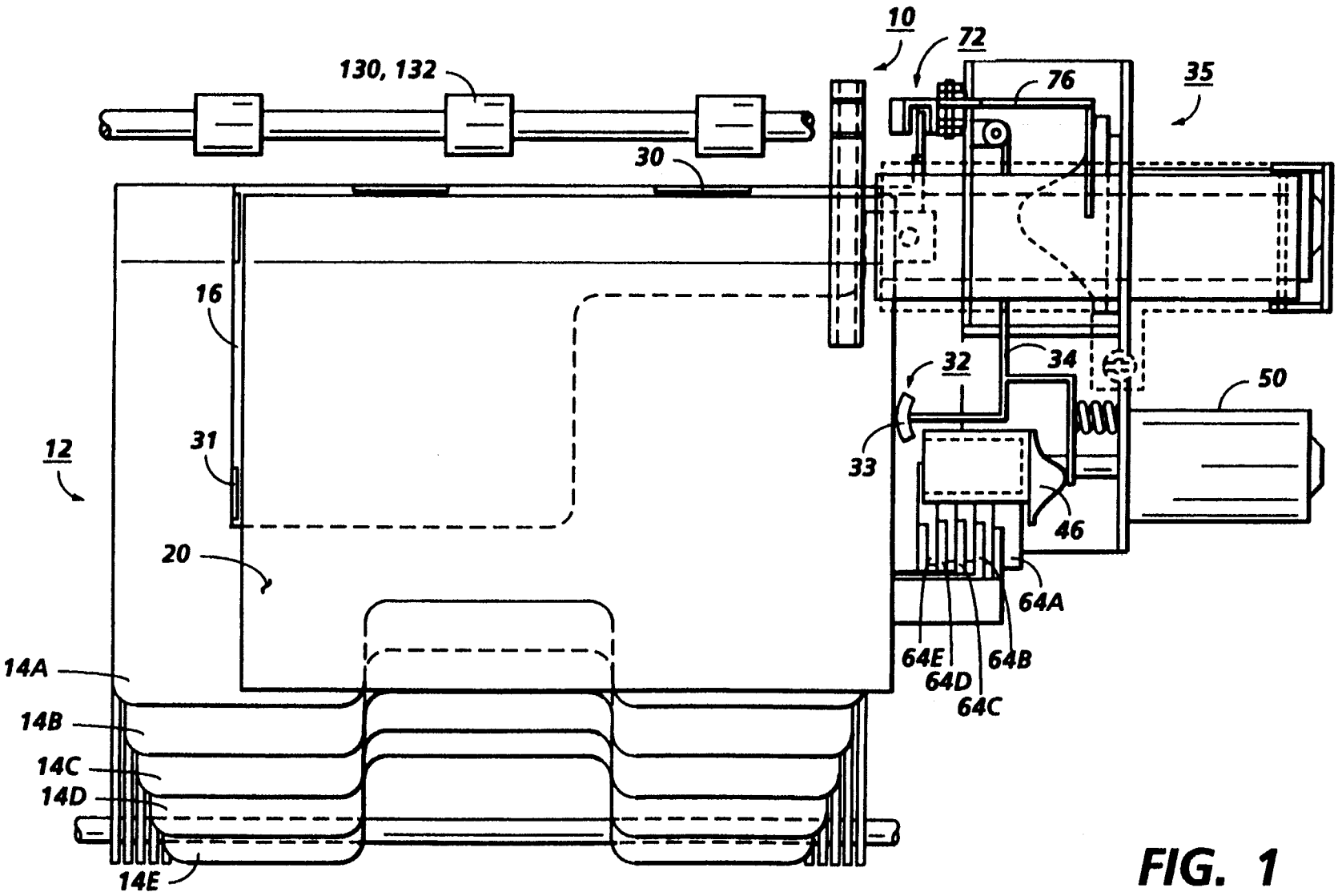
FIG. 1 is a top view of the sorting and finishing apparatus of the present invention.
Figure 7A:
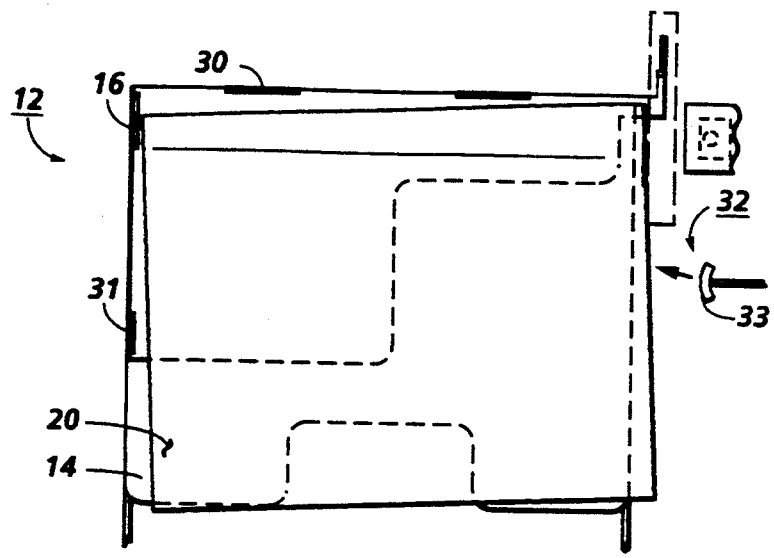
Figure 7B:
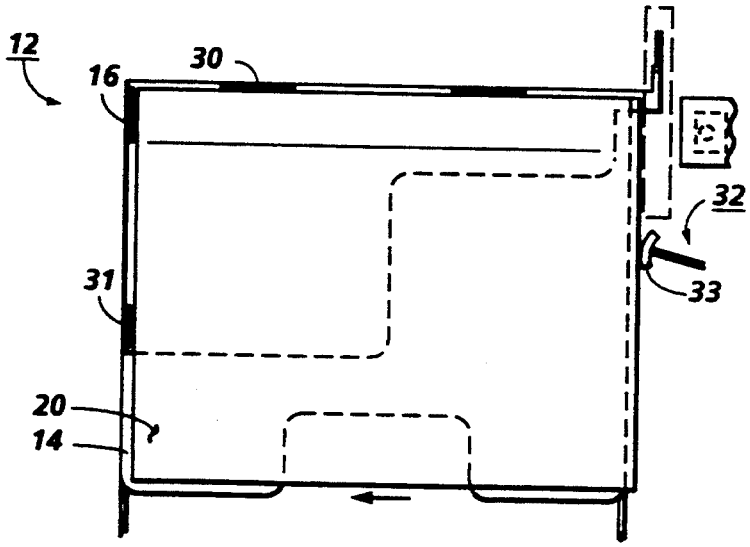
Figure 7C:
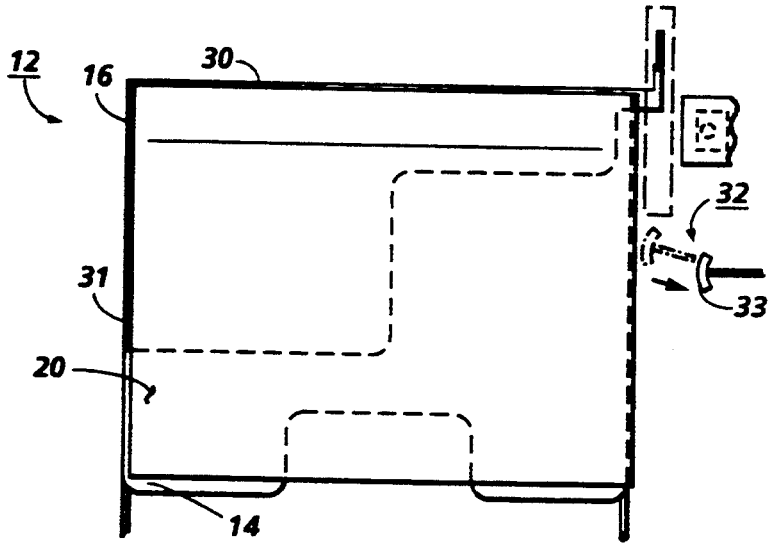
Figure 8A:
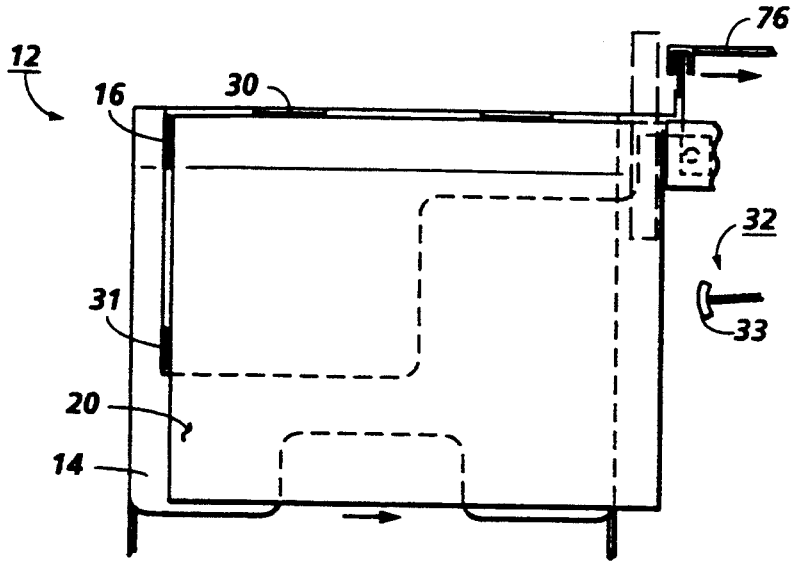
Figure 8B:
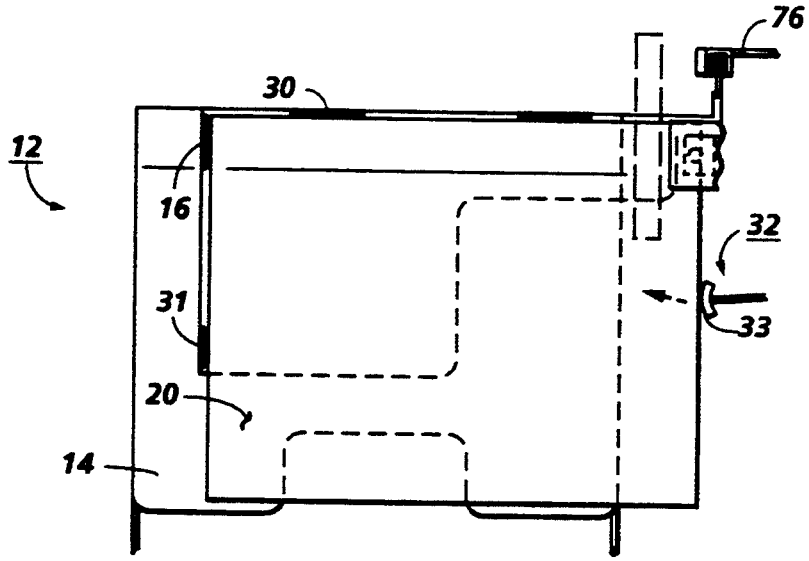
Figure 8C:
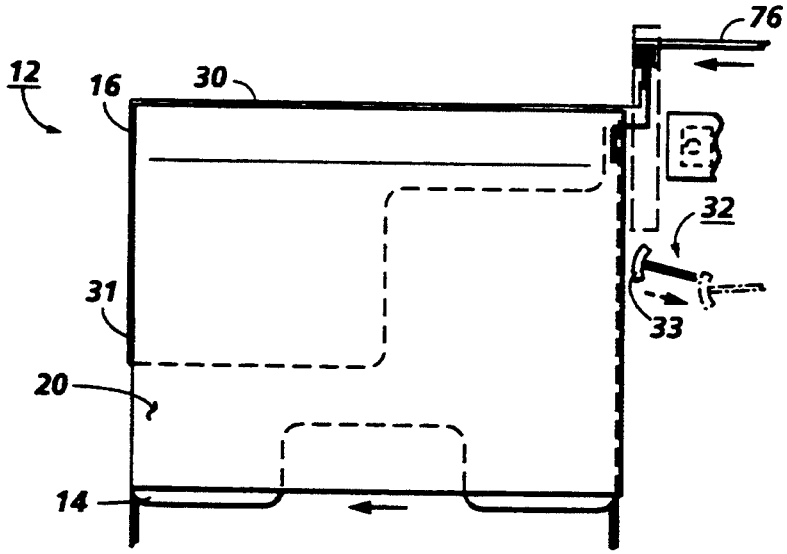

FIGS. 7A, 7B, and 7C are plan views illustrating a tamping cycle for a sheet being discharged into a bin of the FIG. 1 apparatus; and FIGS. 8A, 8B, and 8C are plan views illustrating the stapling cycle for a stack of sheets in a bin of the FIG. 1 apparatus.

In the drawings and the following description, it is to be understood that like numeric designations refer to components of like function. Although specific terms are used in the following description for the sake of clarity, these terms are intended to refer only to the particular structure of the invention selected for illustration in the drawings, and are not intended to define or limit the scope of the invention.

Figure 6:
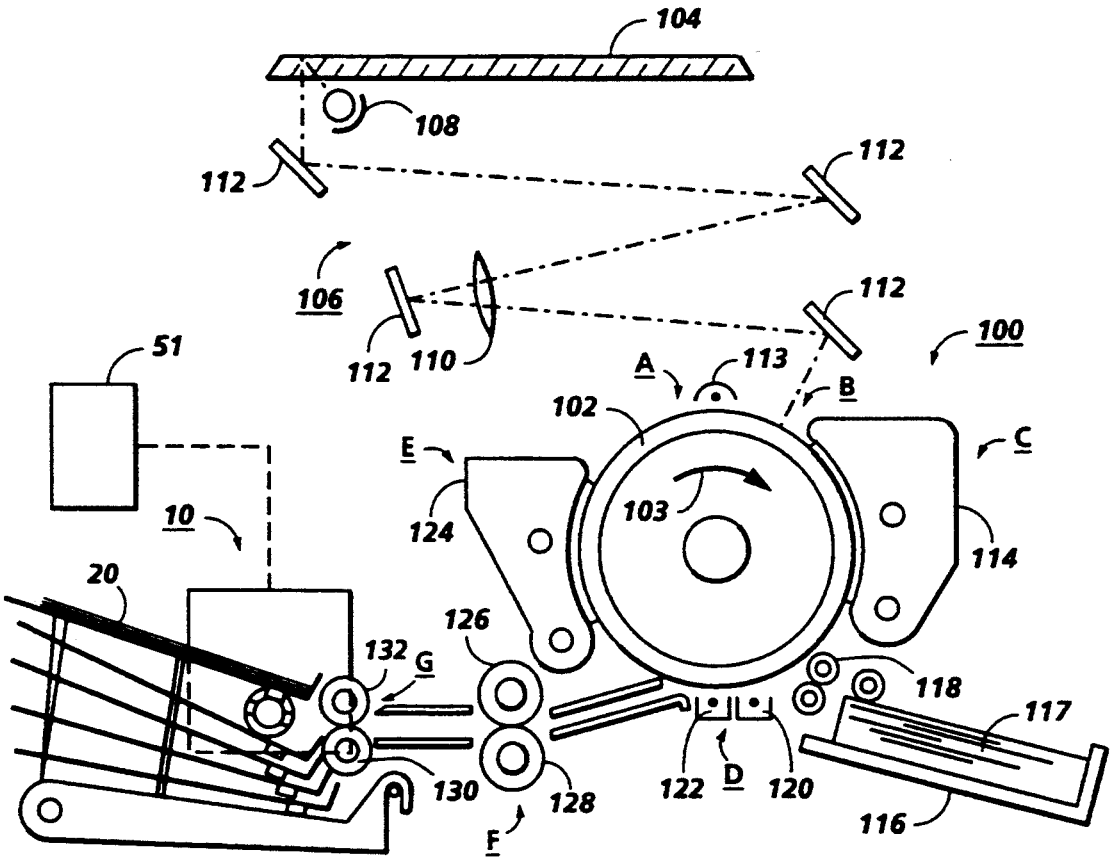
FIG. 6 is a schematic cross section of an electrophotographic copier including the sorting and finishing apparatus of the present invention.

Referring to FIG. 6, there is shown an electrophotographic copying machine 100 having attached thereto a sorting and finishing apparatus 10 according to this invention for collecting and stapling the copy sheets produced in the machine 100. Although the present invention is particularly well suited for use in an electrophotographic copying machine, it is equally well adapted for use with any number of devices, i.e. an automatic reproducing device, in which cut sheets of material are delivered serially for collating into stapled sets.

The electrophotographic copying machine 100 includes a photosensitive drum 102, which is rotated in the direction indicated by the arrow 103, so as to pass sequentially through a series of xerographic processing stations; a charging station A, an imaging station B, a developer station C, a transfer station D, and a cleaning station E.

Initially, drum 102 rotates a portion of photoconductive surface 12 through charging station A. Charging station A employs a corona generating device, indicated generally by the reference numeral 113, to charge photoconductive surface to a relatively high, substantially uniform potential.

Thereafter, drum 102 rotates the charged portion of photoconductive surface to exposure station B. Exposure station B includes an exposure mechanism, indicated generally by the reference numeral 106, having a stationary, transparent platen 104, such as a glass plate or the like for supporting an original document thereon. Lamps 108 illuminate the original document. Scanning of the original document is achieved by oscillating a mirror in a timed relationship with the movement of drum 102 or by translating the lamps and lens 110 across the original document so as to create incremental light images which are reflected between a series of mirrors 112 onto the charged portion of drum 102. Irradiation of the charged portion of photoconductive surface of the drum 102 records an electrostatic latent image corresponding to the informational areas contained within the original document. Obviously, electronic imaging of page image information could be facilitated by a printing apparatus utilizing electrical imaging signals. The printing apparatus can be a digital copier including an input device such as a raster input scanner (RIS) and a printer output device such as a raster output scanner (ROS), or, a printer utilizing a printer output device such as a ROS.

Subsequently, the electrostatic latent image is developed at a developer station C. At the developer station, developer material from a developer housing 114, is caused to flow in contact with the surface of the drum 102. The developer material, in the form of charged toner particles, is attracted to the image area of the drum 102 to form a visible toner image. The surface of the moving drum 102 then transports the toner image to a transfer station D.

Cut sheets of support material 117 are moved into the transfer station D from an input tray 116 via an elevating registering apparatus 118 which is in synchronous relationship with the image on the surface of the drum 102. The back side of the sheet is sprayed with ions discharged from a transfer corotron 120 inducing on the sheet a charge having a polarity and magnitude sufficient to attract the toner material from the surface of the drum 102 to the sheet. The induced charge also electrostatically tacks the sheet to the drum 102. Subsequently, a second transfer corotron 122 induces an opposite charge on the sheet to facilitate the removal of the sheet from the surface of the drum 102. Also, to facilitate removal of the sheet, a stripper finger (not shown) may be utilized to move between the drum 102 and the sheet of support material to lift the sheet from the surface of the drum 102.

The surface of the drum 102 continues along its rotational path passing the cleaning station E, whereat the residual toner remaining on the surface of the drum 102 is removed prior to the charging thereof at charging station A. At the cleaning station E, the residual toner is brought under the influence of a cleaning corotron (not shown) adapted to neutralize the electrostatic charge tending to hold the residual toner to the drum surface. The neutralized toner is mechanically cleaned from the surface of the drum 102 by means of a brush (not shown) or the like. The toner is then collected within the cleaning housing 124. The residual toner may be collected and transported back to the developer housing 114 by a suitable means such a conveyor moving in an endless loop through a tube. The collected residual toner can then be deposited in the developer mix within the developer housing 114 so that it can be reused in the developing process.

Following transfer and stripping, the sheet is directed to a fusing station F. The fusing station F comprises an upper fuser roll 126 and a lower fuser roll 128 mounted in operative relation to each other and arranged to interact so as to support the sheet of support material in pressure driving contact therebetween. At least one of the two rolls is heated (as shown, the upper roll 126), with the other roll typically being a simple pressure roller (as shown, the lower roll 128). As the heated roll 126 is rotated, the heated surface thereof is pressed into contact with the image face of the sheet. Mechanical and heat energy is transported from the roll surface to the support material permanently bonding the toner particles thereto. Upon leaving the fusing station F, the sheet, having the image fixed thereto, is passed to the input rolls 130 and 132 of a sheet input station G to the sorting and finishing apparatus 10. The input rolls 130 and 132 are an output with respect to the xerographic process but act as input with respect to the sorting and finishing apparatus 10. As will be apparent from the machine geometry illustrated in FIG. 6, the sheet is conveyed to the sorting and finishing apparatus 10 face up.

The foregoing description should be sufficient to illustrate the general operation of an electrophotographic copying machine 100. The electrophotographic copy machine 100 is but one example of a wide variety of devices, which deliver cut sheets of material serially for collating into stapled sets, which may incorporate the sorting and finishing apparatus 10 of the present invention therein. As described, an electrophotographic copying system may take the form of any of several well known devices or systems. Variations of specific electrophotographic processing subsystems or processes may be expected without affecting the operation of the present invention.

Turning to the specific subject matter of the present invention, with reference to the FIGS. 1–5, there is illustrated the sorting and finishing apparatus, hereinafter referred to as the sorter 10, of the present invention. The sorter 10 is adapted for use with a device, such as an electrophotographic copying machine, which delivers cut sheets of material serially for collating into stapled sets. The sorter 10 comprises an array 12 of bins 14, with each bin 14 having a suitable means for urging a set of copy sheets therein transverse to the direction of the path of the sheets entering into the bins. In the illustrative example of FIGS. 1–3, the suitable urging means comprises a slidable tray 16 mounted to the top surface of the bin 14. In the illustrative examples, the array 12 is a generally vertical array of horizontally extending bins 14, but the array 12 and the bins 14 thereof may be positioned or disposed as desired to function efficiently in combination with a selected device which delivers cut sheets of material serially for collating into stapled sets. The plurality of bins 14 are arranged in a nest-like configuration wherein the bins 14 are positioned one on top of another.

Figure 2:
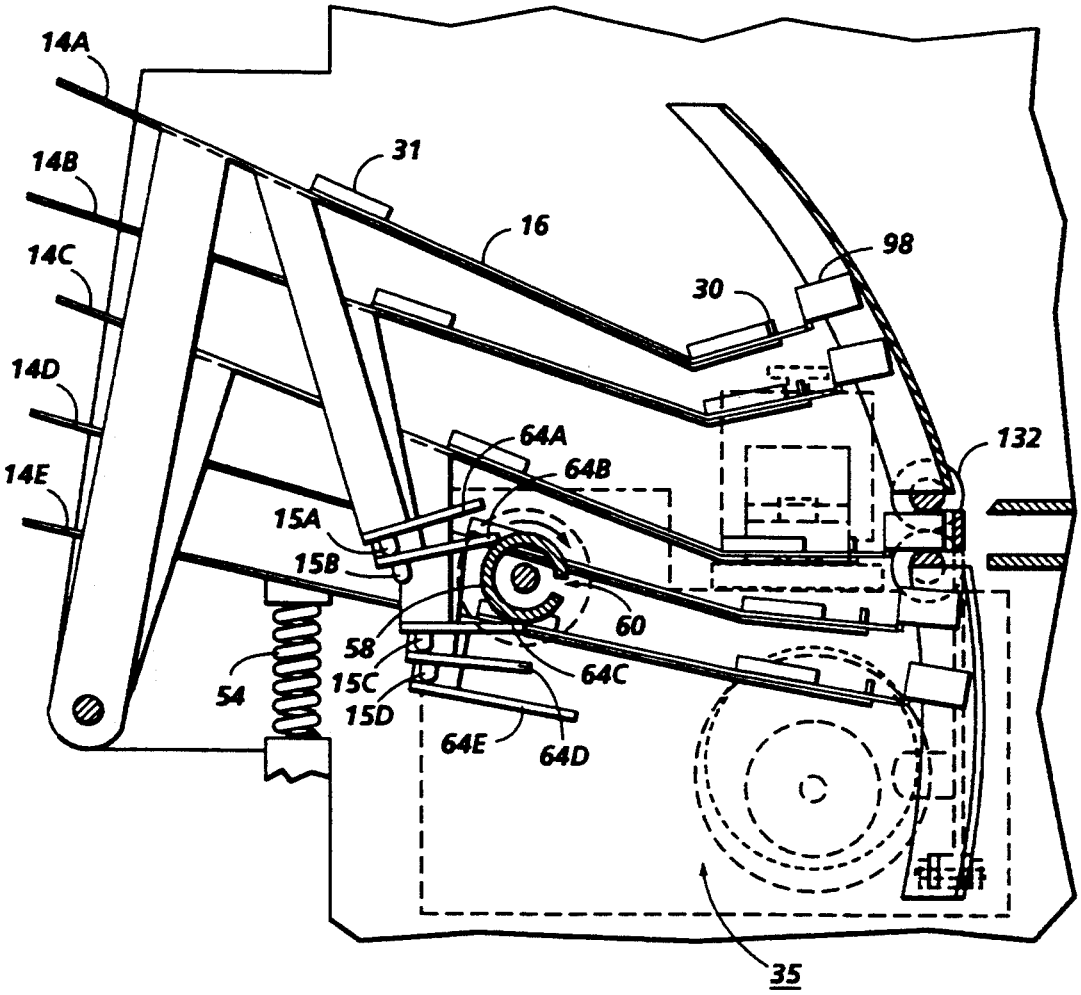
FIG. 2 is a side elevational view of the sorting and finishing apparatus.
Figure 3:
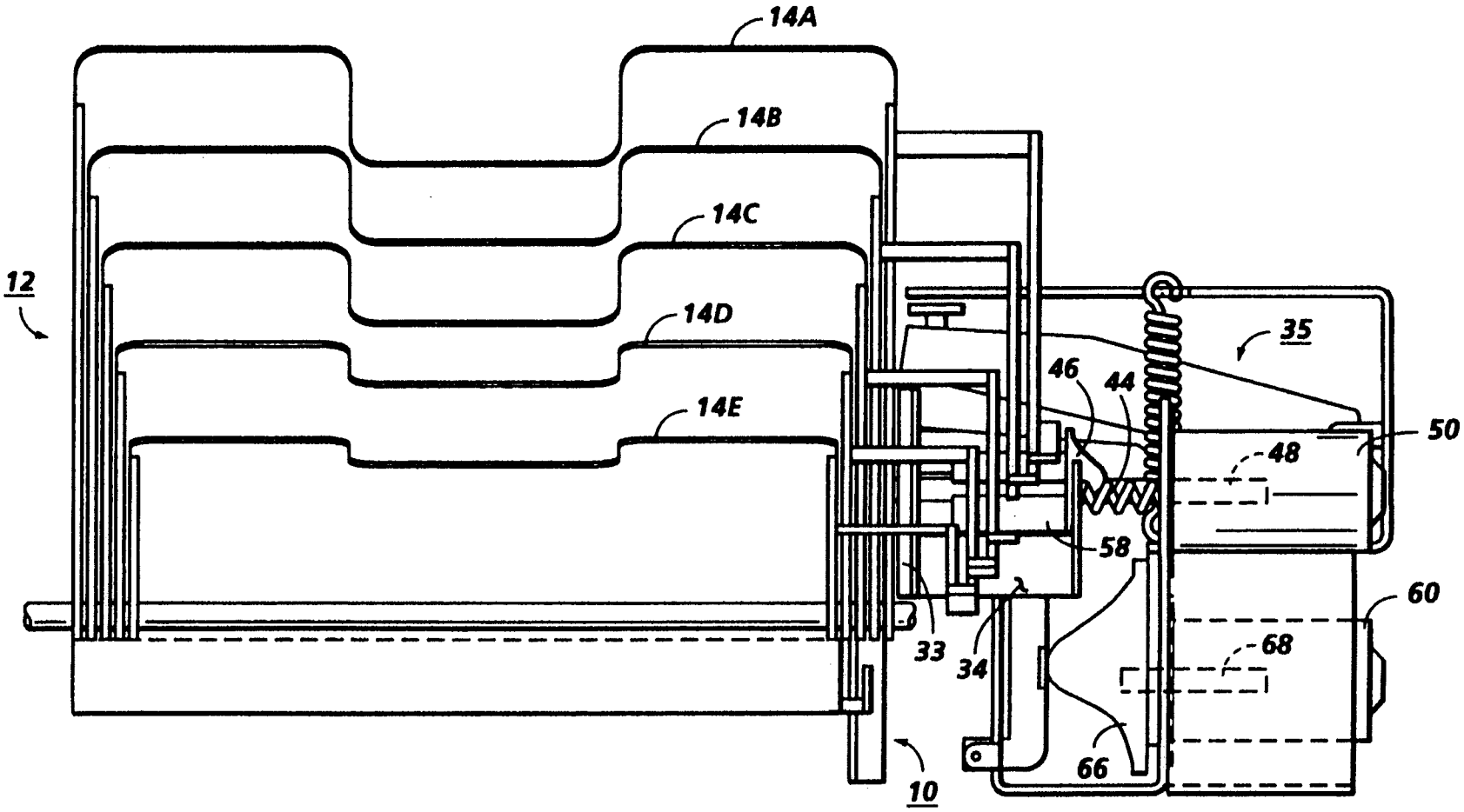
FIG. 3 is an end elevational view of the sorting and finishing apparatus.

With specific reference to FIGS. 1, 2 and 3, there is illustrated the bin array 12. The bin array 12 can comprise any number of bins 14 and the number of bins 14 A–E shown is for illustrative purposes only. The operation of the bins and the indexing method therefor are described in detail in U.S. Pat. No. 4,558,860 to Stemmle which is herein incorporated by reference. While the preferred embodiment is illustrated with the nested bin arrangement of the above referenced patent, it is clear that it may be utilized with any substantially vertical bin arrangement in which the bins cycle past a fixed load point. The specific indexing, tamping, stapling and sliding tray drive mechanism is generally referred to as reference numeral 35, and is shown in detail in FIGS. 4 and 5.

Although the bins 14 are generally horizontally extending, the output end of each bin 14 is at a level higher than the input end so that the bins 14 slope upwardly from the input end to the output end, as shown in FIG. 2, providing an uphill stacking of the individual sheets as they are inserted in each of the bins 14. Once inserted in the uphill orientation, individual sheets in the bins 14 will readily fall by the force of gravity registering the trailing edge thereof against a back stop lip 30 of the slidable tray 16. In addition, sheet tamping mechanism 32 tamps each newly loaded sheet against an upstanding lip 31 of the slidable tray 16. The upstanding lip 31 extends generally perpendicular to the back stop lip 30 of the tray 16.

Referring further to FIGS. 1–3, the illustrative tamping mechanism 32 comprises a generally horizontally extending bar 34 having a vertical extending abutting member 33 at the distal end of the bar 34. The vertical span or height of the abutting member 33 need not be smaller than the spacing between bins as it moves in a cut out area of the bottom of each bin 14 and each bin is substantially vertically aligned. A suitable driving means provides horizontal displacement of the tamping mechanism 32 to urge or tamp the sheets against the upstanding lip 31 of the slidable tray 16. For example, as is described in further detail below, the horizontal bar 34 may be pivotally mounted so as to move in a horizontal plane. A horizontally extending oblong cam 46 mounted to a vertically extending output shaft 48 of a reversible motor 50, could be rotated to contact the bar 34 and swing the tamping mechanism 32 in the horizontal plane. The bar 34 could be spring biased, preferably at the distal end thereof, by the spring mechanism 44 in the direction of the cam 46 to maintain contact therewith. Solenoid actuated arms and/or levers, cylinders, biasing mechanisms, gears and/or other mechanical devices may be employed to provide the horizontal displacement of the tamping mechanism 32.

Regardless of the mechanism and the arrangement employed, the tamping mechanism 32 is displaced in a horizontal plane at the sheet receiving elevation of each of the bins 14 during the sorting operation. The tamping mechanism 32 is displaced concurrent or immediately subsequent to the receipt of a sheet in a bin 14. The vertically extending abutting member 33 contacts the side edge of the sheet and urges the sheet tamping it against the upstanding lip 31, of the slidable tray 16. A sensor (not shown) could be positioned in a suitable location along the path of movement of the sheet, such as adjacent the sorter input rolls or within the respective bins 14, to determine when the sheet has entered a bin 14. The sensor could be a charged coupled device comprising a light emitter and light receiver which can detect the presence of a sheet at a particular location in the path of the sheet by detecting the interruption by the sheet of the light beam between an emitter and receiver pair. A variety of other suitable sensors are well known in the art and can be utilized as well. A microprocessor controller 51 upon receiving a signal indicative that the sheet has entered the bin 14 would generate a signal to the driving means to initiate the horizontal movement of the tamping mechanism 32. In this fashion, the tamping mechanism 32 can register each sheet collated in the respective bins 14 against the upstanding lip 31.

A tamping sequence of a single bin 14 is illustrated in FIGS. 7A through 7C inclusive, wherein FIG. 7A illustrates the sheet as discharged into the bin 14, FIG. 7B shows the sheet being tamped into position against lip 31 by tamping mechanism 32, and FIG. 7C shows the sheet aligned in the bin 14.

In particular, the illustrative indexing and tamping mechanism 35 of the FIGS. 1–3 comprises a rotary shifting C-cam member 58, having an engagement slot 60 therein, driven by a reversible motor 50. The C-cam member 58 rotates in a clockwise direction effectuating the engagement of the engagement slot 60 thereof with an tab 64C integral with the bin 14C. The tab 64C is typical of a plurality of tabs 64A–E, each individually connected to the bins 14A–E, respectively, of the array 12. The bins 14 are biased upwardly against the C-cam 58 by the spring biasing mechanism 54 so that the indexing tabs 64A–E readily fall into position within the open engagement slot 60 as the C-cam 58 rotated. On continued rotation of the C-cam 58 in a clockwise direction, the indexing tab 64C is raised upwardly, thereby, elevating the bin 14C, thereby changing the relatively more open spacing at the input end shown between bins 14C and 14B in FIG. 2 to a more narrow space as shown between bins 14A and 14B and causing the space between bins 14C and 14D to become relatively more open. Thereafter, a copy sheet may be driven by the input rolls at the sheet input station into the bin 14D.

The bins 14A–E, in addition to being provided with indexing tabs 64A–D, are also provided with spacing elements 15A, 15B, 15C, 15D of any suitable size to provide spacing between adjacent bins 14 when in a nesting position. The nesting position refers to the initial position of the bins 14 prior to receiving sheets in which the uppermost bin 14A is positioned below the exit of the input rolls at the sheet input station. On continued rotation, the engagement slot 60 of the C-cam member 58 will engage successive tabs 64A–E, thereby raising the individual bins 14 of the array 12 sequentially upward so that the second lowermost bin 14D finally rests on top of the C-cam 58.

The lowermost tab 64E, connected to the lowermost bin 14E is longer than the tabs 64A–D of the other bins 14A–D so that it will not be engaged by the slot 60 of the C-cam 58. This prevents the lowermost bin 14E form moving across the input gap of the sheet input station since the lowermost bin 14E is required to stop below the input gap to receive the sheets. The biasing force provided by the spring biasing mechanism 54 through the lowermost bin 14E transmits a force to the second lowermost bin 14D by the lowermost spacing element of the lowermost bin 14E. The second lowermost bin 14D subsequently transmits a force to the bin 14C thereabove through the spacing element of the second lowermost bin 14D. The biasing force is subsequently transmitted to each of the spacing elements and bins 14 in this fashion. The slot 60 in the C-cam 58 when rotated to the bottom, engages the indexing tab 64 of the next adjacent bin 14 and lifts the bin 14 across the sheet input entry so that gravity holds the bin 14 against the top of the C-cam 58.

If desired, the sorter 10 can be used to operate either in a unidirectional manner as indicated above or it can be operated in a bidirectional manner, sorting sheets as the individual bins 14 are indexed both upward and downward. If bidirectional indexing is employed, as the last sheet of each copy run is placed in the final bin 14, the bins 14 cease to index, thereby, enabling the first copy of the next page to be loaded in the bin 14 which received the last copy of the previous page. To achieve the downward indexing required for bidirectional indexing, the C-cam 58 and the slot 60 thereof are rotated in the opposite direction, counterclockwise as opposed to clockwise. The engagement slot 60 of the C-cam 58 engages the tab 64D of the second lowermost bin 14D, thereby forcing the lowermost bin 14E downward against spring biasing mechanism 54. Each bin 14 is then engaged through its tab 64 in succession to react against the next the lowermost bin by way of the spacing elements 15A, 15B, 15C, 15D and thereby indirectly against the force of the spring biasing mechanism 54 to be indexed downwardly to provide bidirectional sorting capability. Once in the nesting position, a switch (not shown) is engaged to communicate to the sorter 10 that the bins 14 are in the nesting position, and are ready to be indexed in an upward direction.

Figure 4:
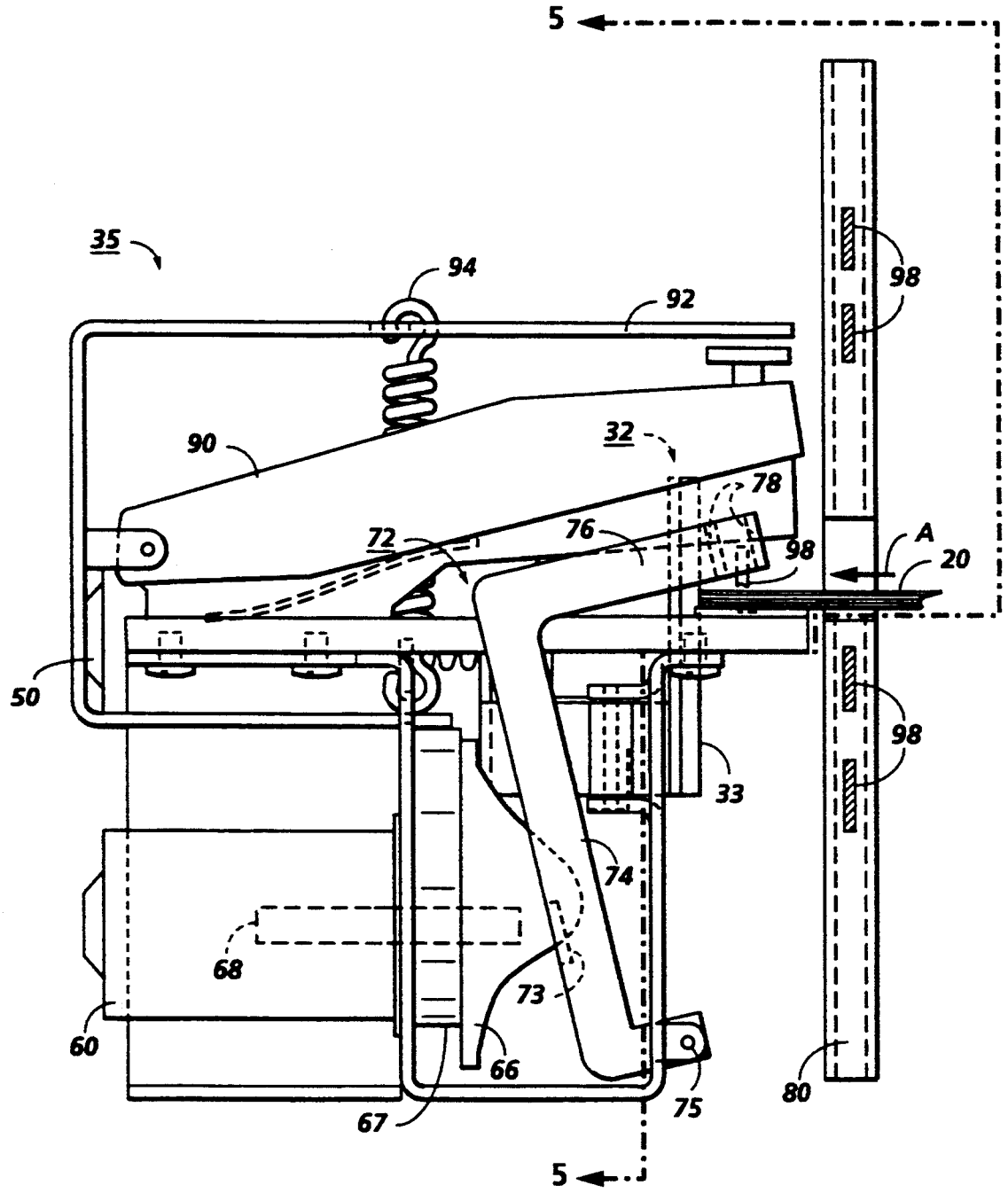
FIG. 4 is a side elevational view of the bin indexing and set stapling apparatus.

Once the sheets are discharged into and compiled in the sorter bins 14, the stapling operation can begin. In the stapling operation, the indexing mechanism 35 positions each of the individual bins 14 at the proper elevation to be aligned with the stapler in the same fashion as the indexing mechanism 35 positions the individual bins 14 in alignment to receive the sheets from the sheet input station during the sorting operation. Each of the bins 14 may have the location of their respective sheet input positions and sheet binding positions at the same elevation as shown in the figures herein or at different elevations depending on the application. When an individual bin 14 is positioned in alignment with the stapling means, the slidable tray 16 of the individual bin 14 is generally horizontally displaced to position the set of copy sheets from the bin 14 into position to be stapled by the stapling means 90 (FIG. 4).

The generally horizontal displacement of each of the sets of copy sheets within the respective bins 14 to the stapler can be accomplished using a suitable urging means such as the illustrative slidable tray 16. In the illustrative example of FIGS. 1–3, a horizontal extending slidable tray 16 is positioned within each of the bins 14 as shown. The horizontal movement of the sliding tray 16 is a obtained by the horizontal movement of a sliding tray arm 72. The illustrative sliding tray arm 72, of FIGS. 1–3, which can be seen in greater detail in FIGS. 4 and 5, has a vertically extending bar portion 74, a horizontally extending bar portion 76 and spaced apart prongs 78 but can be configured in any suitable configuration which will urge the tray 16 in the desired fashion. The sliding tray arm 72 has one end, adjacent the tray 16, whereat horizontally extending spaced apart prongs 78 are integral with one end of the horizontally extending bar 76 of the sliding tray arm 72. The horizontally extending bar 76 extends transverse to the spaced apart prongs 78, preferably perpendicular thereto. The other end of the horizontal bar 76, spaced further away from the tray 16, extends downward to the vertically extending bar 74 of the tray arm 72.

Each slidable tray 16 has a flag type tab 98 projecting upward therefrom. The flags 98 of the respective trays 16 are sequentially aligned within an acquisition channel integral formed by spaced apart prongs 78 at the end of the tray arm 72 opposite the pivot point 75. The acquisition channel is adapted to extend horizontally about the flags 98 when the flags are aligned with the acquisition channel portion of the main guide channel 80. The opening formed by the acquisition channel prongs is larger than the width of the flag 98. The large spacing of the channel relative to the flags 98 permits the vertical movement of the bins 14 and the trays 16 during indexing without interfering with the vertical movement of the trays 16. Once the acquisition channel of the prongs 78 is about the flag 98 of each slidable tray the horizontal displacement of the tray arm 72 can then be effectuated as is described in further detail below.

The movement of the tray arm 72 can be accomplished in a variety of ways. For example, the tray arm can be driven by a motor, reciprocated by a solenoid or pneumatic piston, or by any other conventional drive means. In the illustrative example of FIGS. 1–3, the lower end of the vertical bar 74 of the tray arm 72 is pivotally mounted to the support frame, and the tray arm 72 has a cam follower 73 which is biased against a cam 66 located on the shaft 68 of the stapling motor 60. As torque is transmitted to the cam member 66, the cam member 66 rotates and the tray arm 72 reciprocates about its pivot point 75 of attachment causing the transverse movement of the slidable bin tray 16. Obviously, other devices such as moving fingers or clamps can also be used to transversely shift the sheet set.

As the slidable tray is moved in the transverse direction of Arrow A and into the throat of the stapler 90, a second cam 67 located on the stapler motor shaft 68 actuates the stapler 90 in a timed relation with the movement of the slidable tray 16 to attach the set of sheets 20.

The illustrating slidable tray 16 has a generally extending L-shape particularly suited for attaching the corners of the set of sheets without interference from the tray 16 since the L-shape does not cover a surface of one corner of the set. However, the tray can be in a variety of shapes, such as square, and can be engaged by the tray arm 72 in a variety of ways such as a pin and hook or a clamping device. The horizontal displacement of the tray 16 effectuates the movement of the set of sheets therein through the force exerted by the back stop lip 33 of the tray 16 when the tray 16 is horizontally displaced by any of the previously described methods.

A stapling sequence of a single slidable tray 16 is illustrated in FIGS. 8A through 8C inclusive, wherein FIG. 8A illustrates the sorted registered stack to be stapled, FIG. 8B shows the stack being slid into the throat of stapler 90, and FIG. 8C shows the stapled stack being returned to the loading position in the bin 14 to be removed.

Preferably, each of the bins 14 have at least one guide rail (not shown) adapted to be contacted by the edges of the slidable tray 16. The guide rails can extend upward from the sheet receiving surface of the bin or extend inward from upstanding projection along the sides of the bins 14. The guides are suitably lubricated or constructed of a low friction material to facilitate the sliding movement of a respective tray 16 within a respective bin 14.

Aligned with the slidable tray, stapling or other binding means is effectively positioned to attach a completed set of copy sheets resting in the slidable tray. In the preferred embodiment, the stapling means is located at the input end of the bin array and generally adjacent the front corner of the sorter trays, forward of the paper feed path. The stapling means can be fixed or movable, but is preferably fixed. The stapling means is thus easily accessible to the operator. The stapling means does not interfere with the paper in the trays as the trays index up and down during the previously described sorting operation.

Figure 5:
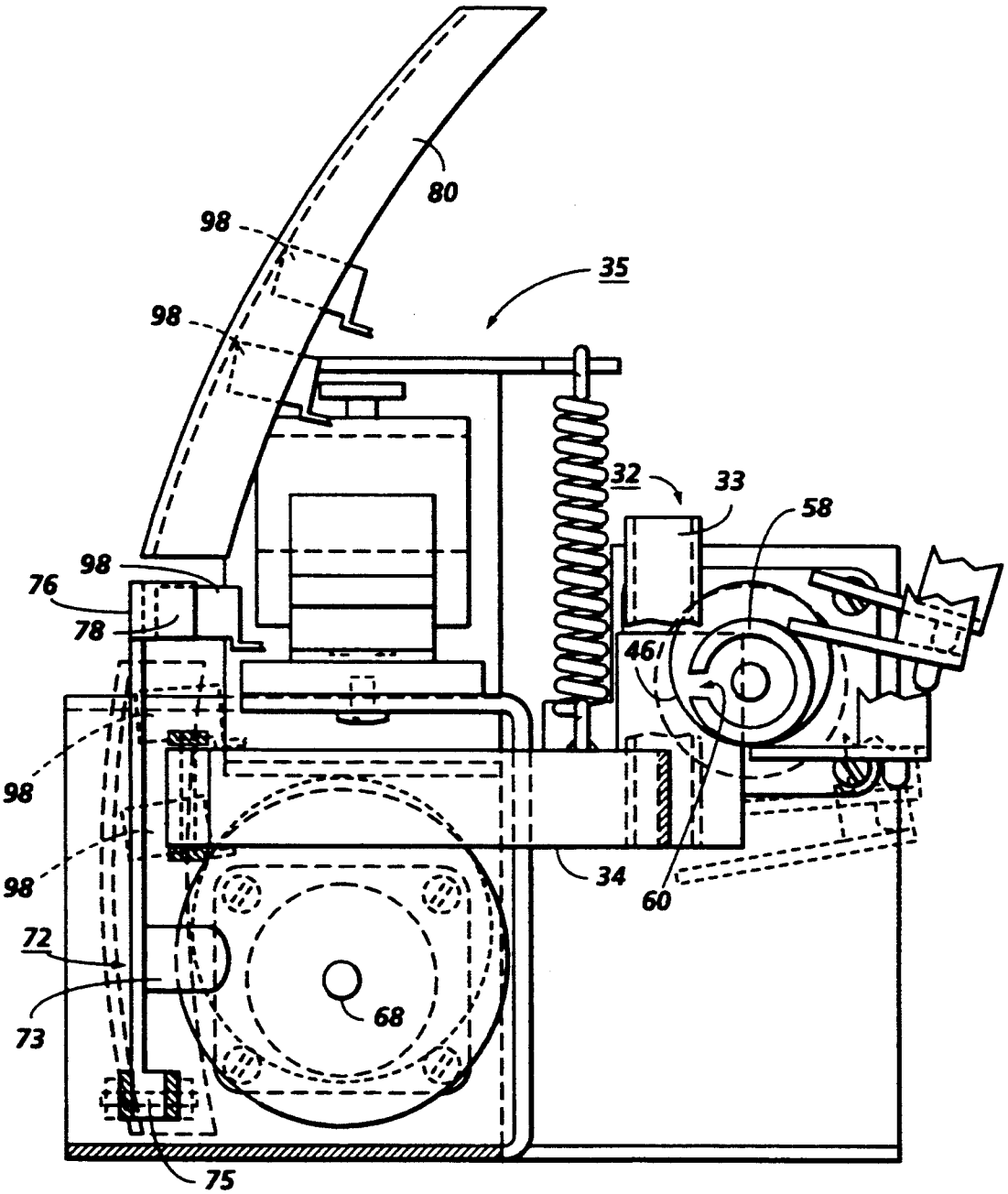
FIG. 5 is an end elevational view of the bin indexing and set stapling apparatus.

Referring now to FIGS. 4 and 5, the details of the bin indexing, tamping, stapling and tray shifting mechanism 35 can be examined. Referring first to FIG. 5, the indexing C-cam 58 which is mounted coaxially with the tamper actuating cam 46 (more clearly seen in FIGS. 1 and 3) can be seen. As the C-cam 58 is rotated by a motor 50, each bin tab 64 is sequentially raised from a position below the C-cam 58 to the top of the C-cam 58 as previously described. During the same single rotation of the C-cam 58, the tamper arm 32 which is spring biased against the tamper cam 46, is caused to be displaced in a horizontal plane thereby pushing each sheet against the registration edges 31 of the slidable tray 16. Each rotation of the C-cam 58 and tamper cam 46 indexes the next bin in sequence and tamps the sheets in the bin. As is previously discussed, the bins can be indexed in either the up or down vertical direction depending on the application. Once the complete sheet sets have been discharged into and compiled in each bin, the stapling motor 53 is then actuated. The stapling motor 53 is driven one rotation as each bin is cycled past the loading station by actuation of the C-cam 58. The pronged end 78 of the sliding tray arm 72, best seen in FIG. 5, engages the flag 98 of each slidable tray 16 as it is positioned at the stapling location. As discussed earlier, the flag 98 of each tray 16 is guided in the channel 80 as the bin is moved up or down. The sliding tray arm 72 is biased against the sliding tray cam 66. As the stapling motor 53 makes a single rotation, the sliding tray arm 72 is displaced in the horizontal direction transverse to the sheet path to pull the sliding tray and the accompanying sheet set into the throat of the stapler 90. At the same time, the stapler cam 67 which is coaxially mounted with the sliding tray cam 66 causes the stapler 90 to drive a staple through the compiled set 20 by way of lever arm 92. The lever arm 92 is biased by a spring 94 so as to maintain contact with the stapler cam 67. This process is repeated for each of the bins until the entire job of compiled sheet sets is fully stapled. Note that when the lever arm 92 is not being actuated by cam 67, the arm 92 does not contact the stapler. Thus, there are no significant loads on the stapler until the stapling cycle is initiated. Since there are very minimal if any loads on the stapler unit may be easily grasped and removed by the operator for staple reloading, jam clearing, etc.

In recapitulation, the sorting and finishing apparatus comprises a generally vertical array of horizontally extending bins, with each bin having a slidable tray mounted thereto for horizontally displacing a set of sheet material, positioned within the bin, into a stapling apparatus. The present invention provides sorting of collated copy sets of sheet material and the stapling thereof while still providing access to the stapler. The stapler is easily removable for reloading staples, restapling documents after completing a copy job, clearing staple jams, and customer replacement of failed staplers.

It is, therefore, apparent that there has been provided in accordance with the present invention, a sorting and finishing apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for sorting sheets, comprising:

a plurality of movable bins shiftable relative to one another with each of said plurality of bins including means for movably supporting the sheets in said bin, said supporting means aligning the sheets in said bin in a sheet aligning position;

means for advancing sheets onto said supporting means, said supporting means being movable in a direction substantially transverse to the direction of advancement of the sheets; and means for attaching the sheets of one of said plurality of bins to one another at a sheet attaching position, said supporting means moving the sheets of said one of said plurality of bins from the sheet aligning position to the sheet attaching position enabling said attaching means to attach the sheets to one another.

2. A sorting apparatus according to claim 1, wherein said supporting means is reversible to move the sheets attached to one another from the sheet attaching position to the sheet aligning position.

3. A printing system, comprising:

means for printing information in sheets;

means, positioned to receive the sheets from said printing means at a sheet inlet region, for sorting the sheets, said sorting means comprising a plurality of movable bins shiftable relative to one another with each of said plurality of bins including means for movably supporting the sheets in said bin, said supporting means aligning the sheets in said bin in a sheet aligning position, said supporting means being movable in a direction substantially transverse to the direction of receipt of the sheets; and means for attaching the sheets of one of said plurality of bins to one another at a sheet attaching position, said supporting means moving the sheets of said one of said plurality of bins from the sheet aligning position to the sheet attaching position enabling said attaching means to attach the sheets to one another.

4. A printing system according to claim 3, wherein said supporting means is reversible to move the sheets attached to one another from the sheet attaching position to the sheet aligning position.

5. An apparatus for sorting sheets, comprising:

a plurality of movable bins shiftable relative to one another with each of said plurality of bins including means for movably supporting the sheets in said bin, said supporting means aligning the sheets in said bin in a sheet aligning position, said supporting means comprises a tray slidably mounted in said bin, said tray having a sheet registration guide along a side thereof and means for moving said tray from the sheet aligning position to a sheet attaching position; and means for attaching the sheets of one of said plurality of bins to one another at the sheet attaching position, said supporting means moving the sheets of said one of said plurality of bins from the sheet aligning position to the sheet attaching position enabling said attaching means to attach the sheets to one another.

6. A sorting apparatus according to claim 5, further including means for advancing sheets onto said tray, said tray being movable in a direction substantially transverse to the direction of advancement of the sheets.

7. A sorting apparatus according to claim 6, wherein said attaching means comprises a stapler adapted to staple the aligned sheets to one another in response to the sheets being in the sheet attaching position.

8. A sorting apparatus according to claim 7, wherein said stapler is removable by an individual operating the apparatus.

9. A sorting apparatus according to claim 7, wherein said stapler remains in a fixed position relative to said bins during the attaching operation.

10. A sorting apparatus according to claim 5, wherein said tray moving means is reversible to move the sheets attached to one another from the sheet attaching position to the sheet aligning position.

11. A printing system, comprising:

means for printing information on sheets;

means, positioned to receive the sheets from said printing means at a sheet inlet region for sorting the sheets, said sorting means comprising a plurality of movable bins shiftable relative to one another with each of said plurality of bins including means for movably supporting the sheets in said bin, said supporting means aligning the sheets in said bin in a sheet aligning position, said supporting means comprises a tray slidably mounted in said bin, said tray having a sheet registration guide along a side thereof and means for moving said tray from the sheet aligning position to a sheet attaching position; and means for attaching the sheets of one of said plurality of bins to one another at the sheet attaching position, said supporting means moving the sheets of said one of said plurality of bins from the sheet aligning position to the sheet attaching position enabling said attaching means to attach the sheets to one another.

12. A printing system according to claim 11, further including means for advancing sheets onto said tray, said tray being movable in a direction substantially transverse to the direction of advancement of the sheets.

13. A printing system according to claim 12, wherein said attaching means comprises a stapler adapted to staple the aligned sheets to one another in response to the sheets being in the sheet attaching position.

14. A printing system according to claim 13, wherein said stapler is removable by an individual operating the apparatus.

15. A printing system according to claim 13, wherein said stapler remains in a fixed position relative to said bins during the attaching operation.

16. A printing system according to claim 11, wherein said tray moving means is reversible to move the sheets attached to one another from the sheet attaching position to the sheet aligning position.

* * * * *